US006793435B2

(12) United States Patent
Higashino et al.

(10) Patent No.: US 6,793,435 B2
(45) Date of Patent: Sep. 21, 2004

(54) BINDER

(75) Inventors: Takayoshi Higashino, Osaka (JP); Kizuku Kitada, Osaka (JP)

(73) Assignee: Kokuyo Co., Ltd. (JP)

( * ) Notice: Subject to any disclaimer, the term of this patent is extended or adjusted under 35 U.S.C. 154(b) by 164 days.

(21) Appl. No.: 10/083,414

(22) Filed: Feb. 27, 2002

(65) Prior Publication Data

US 2002/0141809 A1 Oct. 3, 2002

(30) Foreign Application Priority Data

Apr. 2, 2001 (JP) ..... 2001-103445

(51) Int. Cl.[7] ..... B42F 13/02
(52) U.S. Cl. ..... 402/8; 402/17
(58) Field of Search ..... 402/4, 8, 9, 17, 402/60, 64, 70, 73, 80 R, 80 P, 500, 502; D19/26, 27

(56) References Cited

U.S. PATENT DOCUMENTS 5,096,323 A 3/1992 Walker
5,988,925 A * 11/1999 Baggett ..... 402/8
6,217,246 B1 * 4/2001 Yu ..... 402/8

FOREIGN PATENT DOCUMENTS

GB 2292544 2/1996

* cited by examiner

*Primary Examiner*—Derris H. Banks
*Assistant Examiner*—Jamila Williams
(74) *Attorney, Agent, or Firm*—Lowe Hauptman Gilman & Berner LLP

(57) ABSTRACT

A binder (10) has a base (14) having passages (14A, 14A) through which binding legs (13,13) can be inserted. The base (14) has a plurality of base-forming members (17,17) that can move relative to each other along the longitudinal direction. Each of the base-forming members (17,17) has first and second operating portions (22,23) that move when the base-forming members (17,17) are moved relative to each other. The second operating portions (23,23) move away from each other and press the binding legs (13,13) onto their binding positions when the first operating portions (22,22) are moved toward each other. The binding legs (13,13) are released and the first operating portions (22,22) move away from each other when the second operating portions (23,23) are moved toward each other.

20 Claims, 14 Drawing Sheets

BINDER

BACKGROUND OF THE INVENTION

1. Field of the Invention

The present invention relates to a binder, and more particularly to an improvement in a binder capable of applying binding forces by folding down binding legs along a base.

2. Related Art

Conventionally, a file referred to as a flat file has a base, passages for binding legs, and pressing members. The base is in the shape of a thin strip extending like a plate. The passages are composed of two holes arranged in the longitudinal direction in the base. The pressing members are formed on the side of an upper surface of the base. Each of the pressing members can be slid between a position for opening a corresponding one of the passages and a position for closing the passage. This binder is designed such that binding forces are applied to the binding legs maintained in a folded-down posture when the pressing members are moved away from each other and that each of the binding legs can be drawn out of a corresponding one of the passages when the pressing members are moved toward each other.

However, such a binder is inconvenient in that a binding operation cannot be performed easily only by two fingers of one hand such as a thumb and an index finger, for example, after binding legs have been inserted through passages formed in a base. This results from the fact that pressing members must be moved away from each other when applying binding forces to the binding legs.

SUMMARY OF THE INVENTION

The present invention has been made in an attempt to eliminate the aforementioned inconvenience. It is an objective of the present invention to provide a binder suited to adopt a design in which operational forces are applied in one direction.

In order to achieve the aforementioned object, the present invention provides a binder capable of applying binding forces to binding legs that have been inserted through passages formed in a base extending in the longitudinal direction with a construction wherein the base has a plurality of base-forming members that are arranged relatively movably along the longitudinal direction and that can form the passages, wherein each of the base-forming members has at least one operating portion that moves when the base-forming members are moved relative to each other, and wherein it becomes possible to press or release each of the binding legs by operating the operating portion in a predetermined manner. Such a construction makes it possible to press and release the binding legs by an approaching or pinching operation, for instance, in the case where two operating portions are formed in the longitudinal direction in each of the base-forming members. This makes it possible not only to perform binding and releasing operations easily and smoothly while ensuring that operational forces are applied in one direction during each operation, but also to apply operational forces from fingertips to the operating portions.

Further, the present invention can provide a binder capable of applying binding forces to binding legs that have been inserted through passages formed in a base extending in the longitudinal direction with a construction wherein the base has a plurality of base-forming members that are arranged relatively movably along the longitudinal direction and that can form the passages, wherein each of the base-forming members has first and second operating portions that move when the base-forming members are moved relative to each other, wherein the second operating portions move away from each other and press the binding legs onto their binding positions when the first operating portions are moved toward each other, and wherein the binding legs are released and the first operating portions move away from each other when the second operating portions are moved toward each other. In the case where such a construction is adopted, when the first or second operating portions are moved toward each other, the second or first operating portions are moved away from each other. Therefore, the binding legs can always be pressed and released by moving the corresponding operating portions toward each other. This also makes it possible to achieve simplification of operations while ensuring that operational forces are applied in one direction during each operation.

The present invention preferably adopts a construction wherein the base-forming members are common in shape and wherein the base is formed by combining the base-forming members. Such a construction makes it possible to achieve structural simplification and reduction in cost by reducing the number of types of parts constituting the base.

DETAILED DESCRIPTION OF PREFERRED EMBODIMENT

An embodiment of the present invention will be described hereinafter with reference to the drawings.

Figure 1:
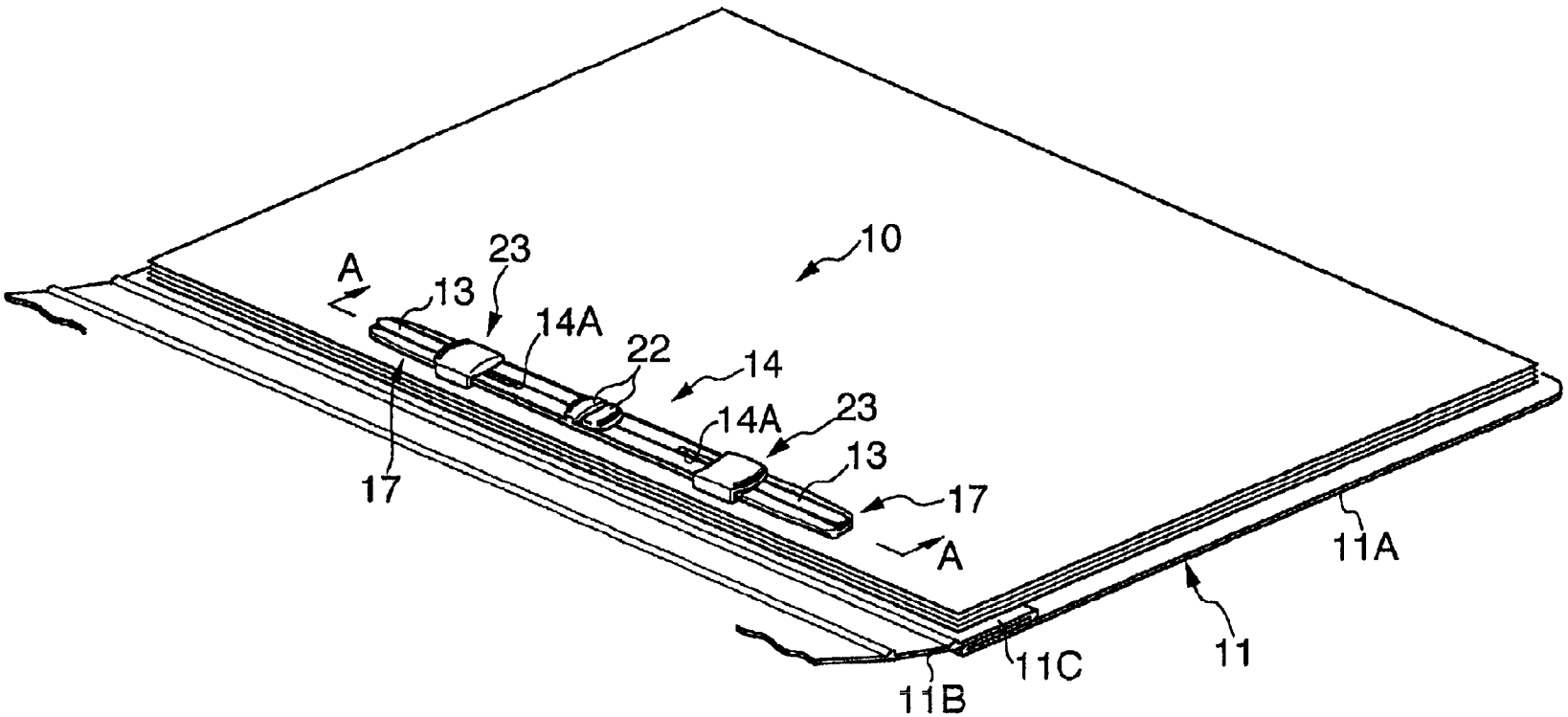
FIG. 1 is a schematic perspective view of a file to which a binder according to an embodiment of the present invention is applied.
Figure 2:
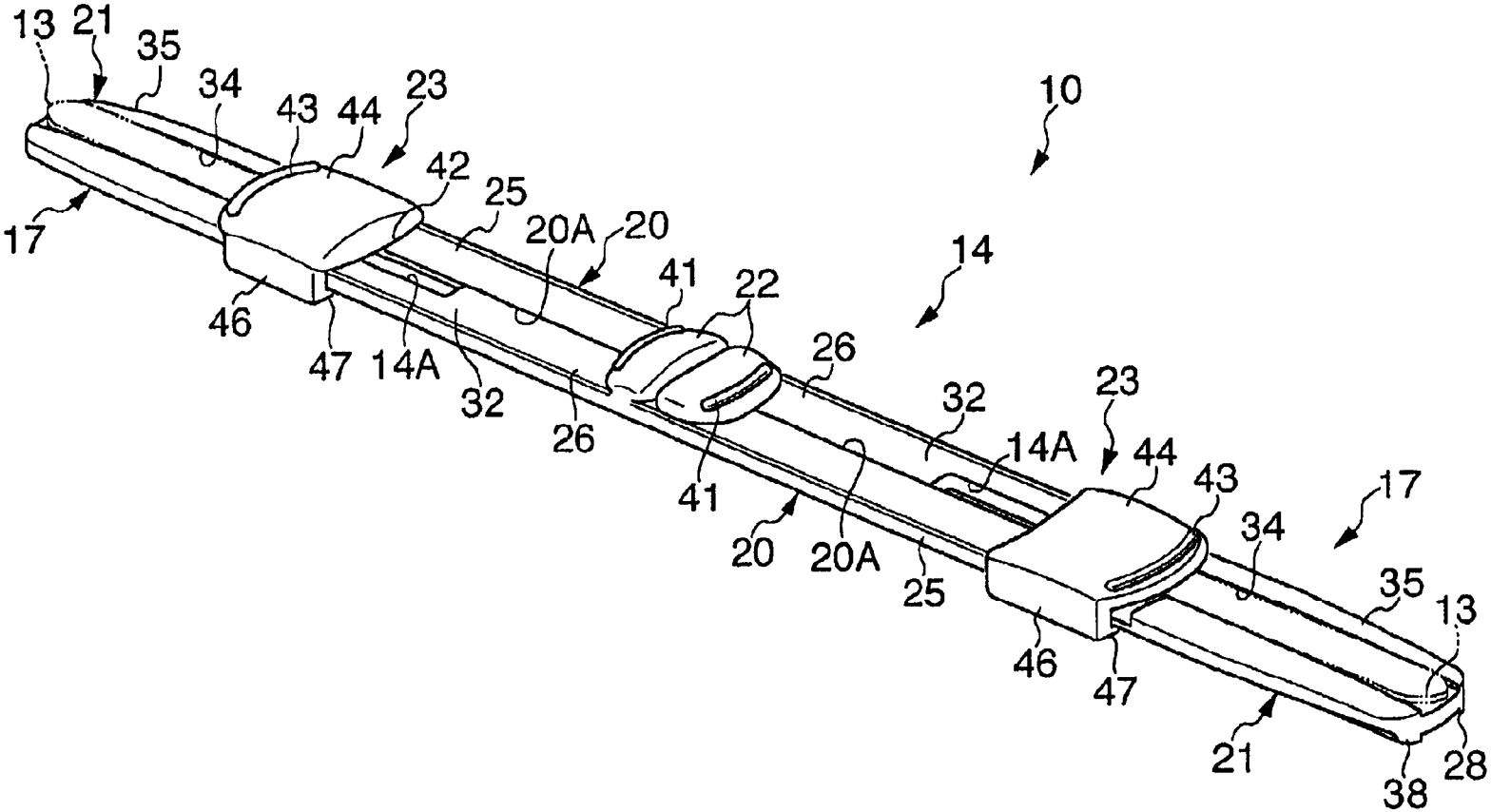
FIG. 2 is an enlarged perspective view of the binder.

FIG. 1 is a schematic perspective view of a file to which a binder according to the first embodiment of the present invention is applied. FIG. 2 is an enlarged perspective view of the binder. In these drawings, a binder 10 is fitted to a folded portion 11C, which is a twofold portion between a reverse cover 11A and a back cover 11B. The reverse cover 11A and the back cover 11B constitute a cover body 11. Papers P can be bound between the binder 10 and the folded portion 11C. The binder 10 has a pair of binding legs 13, 13 and a base 14. The binding legs 13, 13 penetrate the folded portion 11C and extend in such a manner as to protrude above an inner surface of the cover body 11. The binding legs 13, 13 can be inserted through two binding holes P1 (see FIG. 3) punched in the papers P. The base 14 has a pair of slot-shaped passages 14A, 14A through which the binding legs 13, 13 are inserted.

Figure 3:
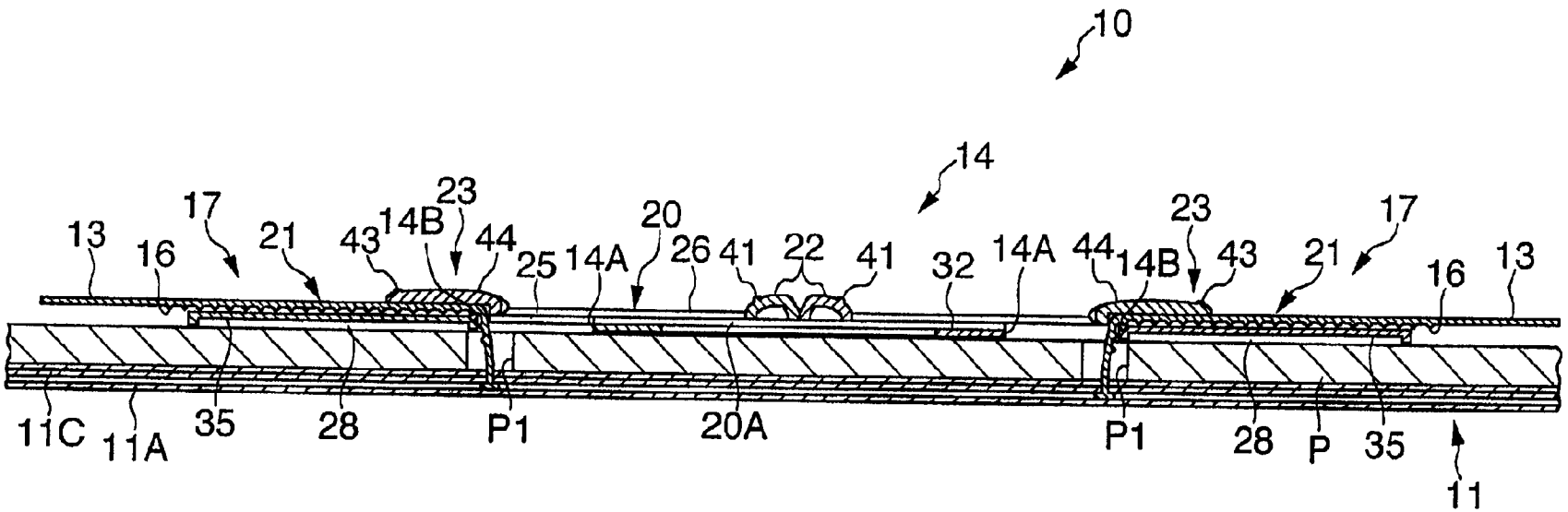
FIG. 3 is a cross-sectional view of FIG. 1 taken along a line A—A.
Figure 4:
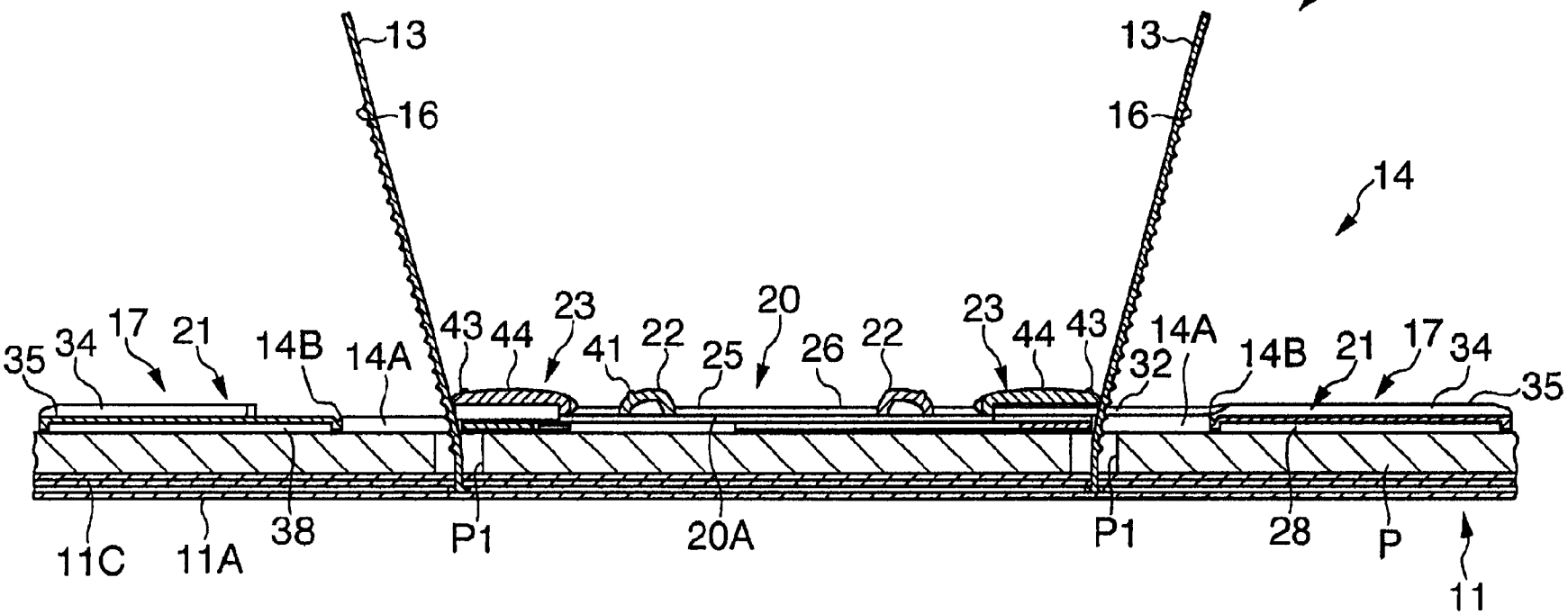
FIG. 4 is a cross-sectional view similar to FIG. 3 and shows a state in which binding legs are about to be folded down.

The binding legs 13, 13 are not to be limited to any specific material or shape. In this embodiment, however, the binding legs 13, 13 are flexible band-shaped members that are formed principally from a resinous material such as polyethylene. As shown in FIGS. 3 and 4, a serrated surface 16 is formed on one side of each of the binding legs 13, 13. Each serrated surface 16 faces downwards when a corresponding one of the binding legs 13, 13 is folded down. The serrated surface 16 meshes with a claw-shaped protrusion 14B formed on an inner peripheral edge of a corresponding one of the passages 14A, 14A, thus making it possible to prevent a corresponding one of the binding legs 13, 13 from moving relative to the base 14.

Figure 5:
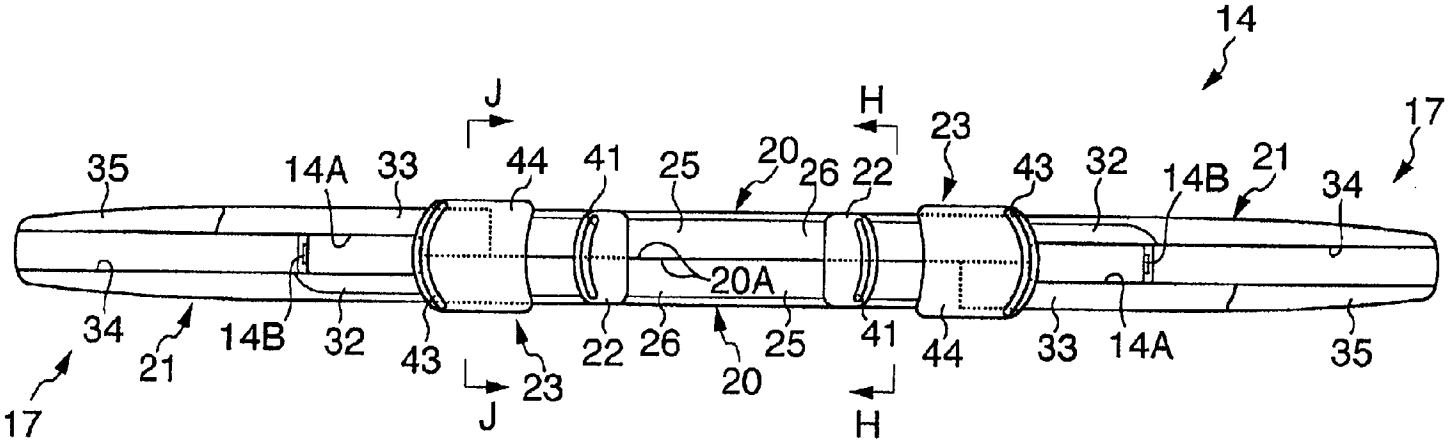
FIG. 5(A) is a plan view of a base in which binding leg-pressing portions are close to each other.
FIG. 5(B) is a plan view of the base in which first operating portions are close to each other.
Figure 5:
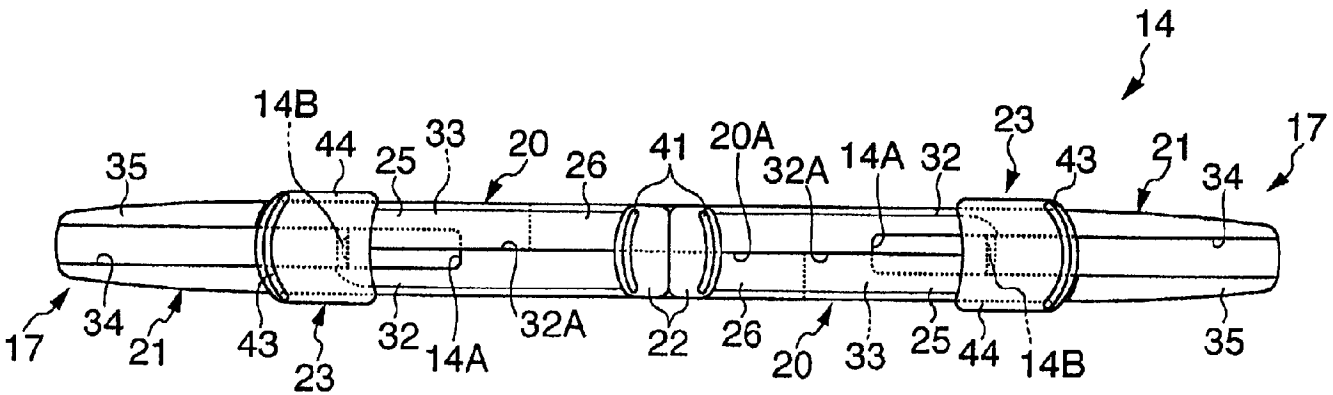

As shown in FIGS. 5(A) and 5(B) as well, the base 14 is composed of a pair of base-forming members 17, 17, which extend in the longitudinal direction and are combined relatively movably. The base-forming members 17, 17 are constructed of integrally molded articles that are made principally from resinous materials such as ABS, PS, and polypropylene. The base 14 is formed by combining the base-forming members 17, 17 that are arranged point-symmetrical to each other in a plan view.

Figure 6:
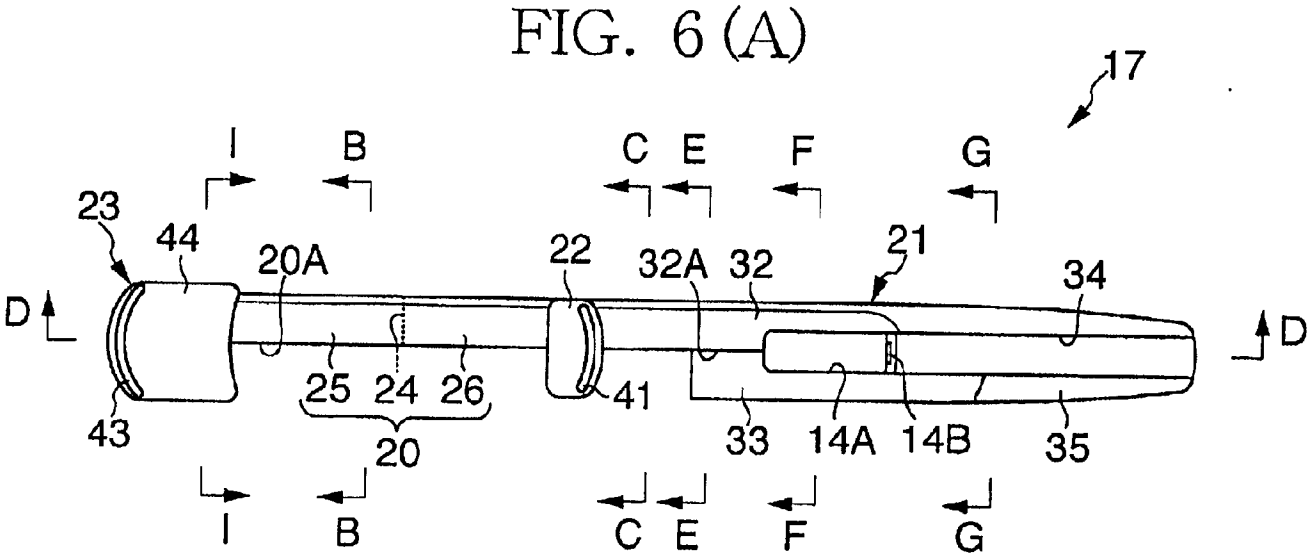
FIG. 6(A) is a plan view of a base-forming member.
FIG. 6(B) is a bottom view of FIG. 6(A).
Figure 6:
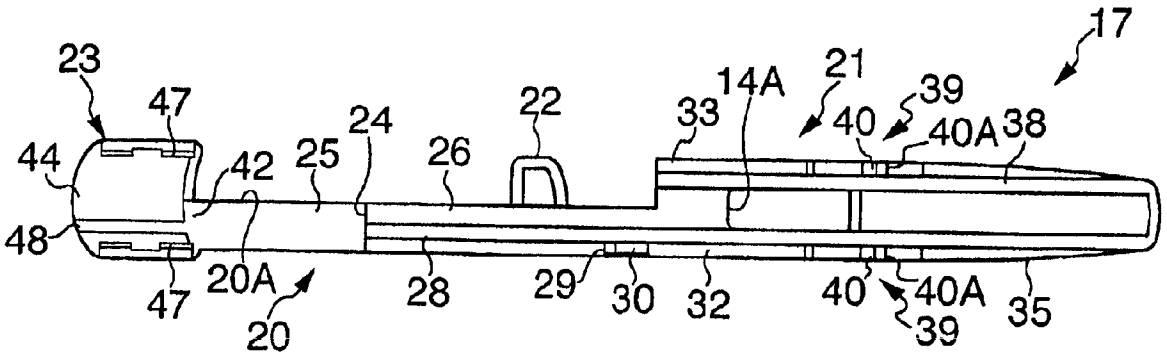

As shown in FIG. 6(A) as well, each of the base-forming members 17, 17 has a first transverse portion 20, a second transverse portion 21, a first operating portion 22, and a binding leg-pressing portion 23 or a second operating portion 23. The first transverse portion 20 extends in the lateral direction in FIG. 6(A), is formed in the shape of a strip, and has an abutment end surface 20A (FIG. 5A), which comes into contact with an abutment end surface 20A of the other base-forming member 17. The second transverse portion 21 extends to the right from the right end of the first transverse portion 20 and is substantially twice as wide as the first transverse portion 20. A corresponding one of the passages 14A, 14A is formed in a surface of the second transverse portion 21. The first operating portion 22 is disposed in such a manner as to protrude above an upper surface of the first transverse portion 20. The binding leg-pressing portion 23 or the second operating portion 23 is disposed at the left end of the first transverse portion 20 in FIG. 6(A).

Figure 7:
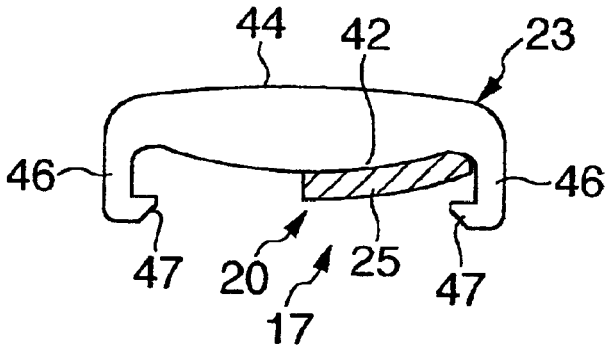
FIG. 7 is an enlarged cross-sectional view of FIG. 6(A) taken along a line B—B.
Figure 8:
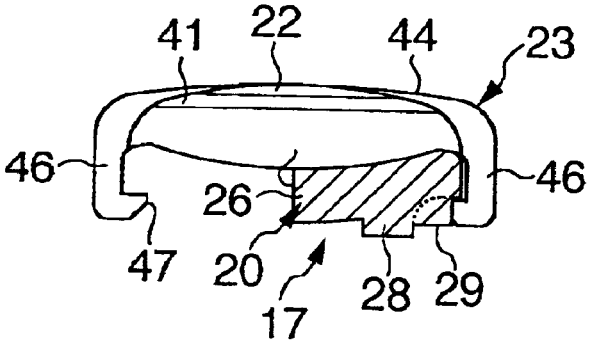
FIG. 8 is an enlarged cross-sectional view of FIG. 6(A) taken along a line C—C.
Figure 9:
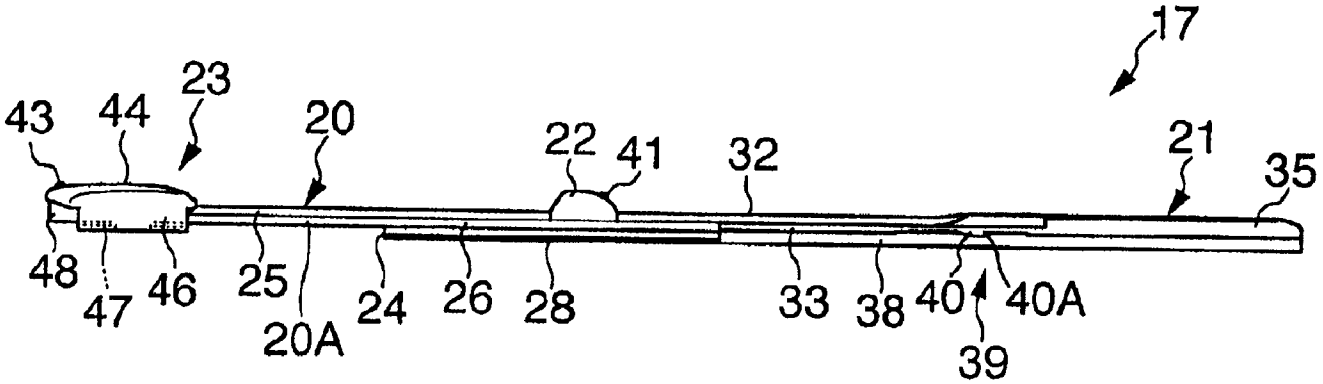
FIG. 9(A) is a front view of FIG. 6(A).
FIG. 9(B) is a rear view of FIG. 6(A).
Figure 9:
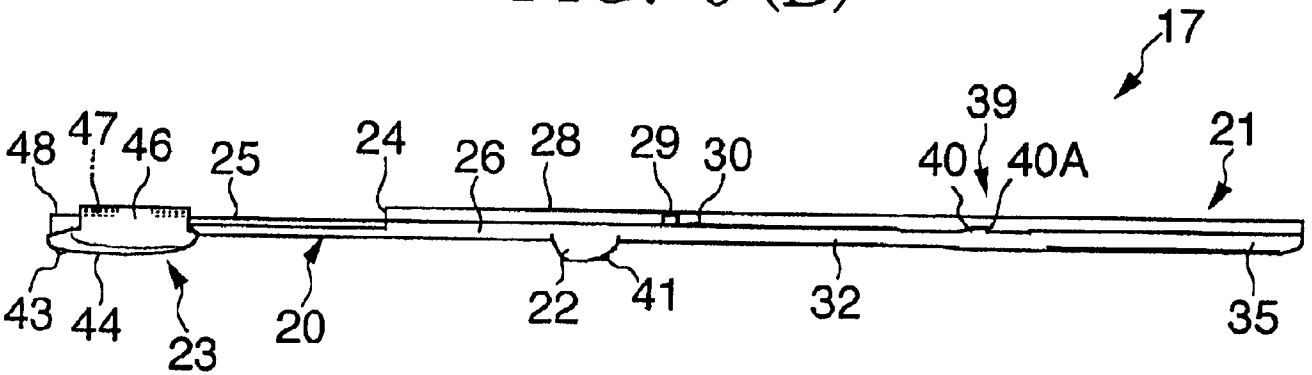
Figure 10:
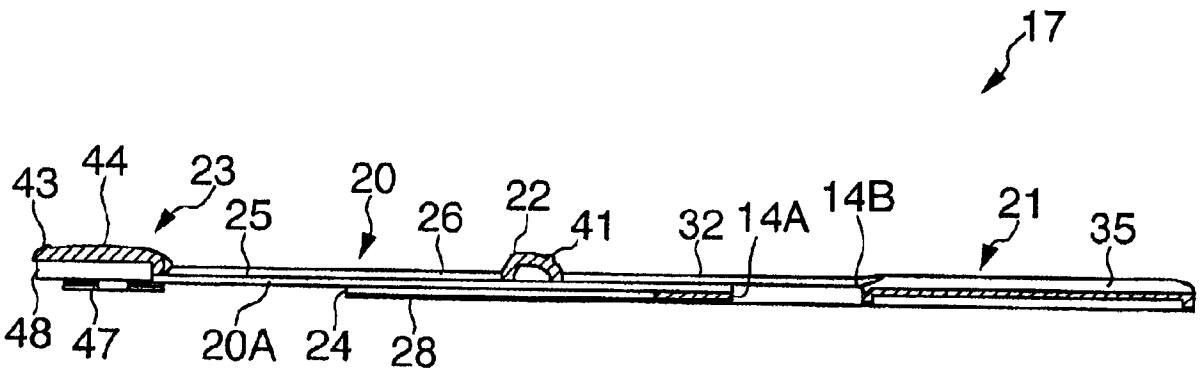
FIG. 10 is a cross-sectional view of FIG. 6(A) taken along a line D—D.

As shown in FIGS. 7 and 8, the first transverse portion 20 is formed in the shape of a strip making a curve that extends upwards to the right when viewed in cross section. As shown in FIGS. 9(A) and 10 as well, an elevation-forming surface 24 is formed on the side of a lower surface of the first transverse portion 20 at a substantially central position in the longitudinal direction (i.e., the left-to-right direction in FIG. 10). The first transverse portion 20 differs in thickness between its region on the left of the elevation-forming surface 24 and its region on the right of the elevation-forming surface 24. That is, the first transverse portion 20 has a first curved-strip portion 25 and a second curved-strip portion 26. The first curved-strip portion 25 extends between the elevation-forming surface 24 and the binding leg-pressing portion 23. The second curved-strip portion 26 extends between the elevation-forming surface 24 and the second transverse portion 21 and is substantially twice as thick as the first curved-strip portion 25. A first protrusive bar portion 28 extending from the elevation-forming surface 24 toward the second transverse portion 21 is disposed on the side of a lower surface of the second curved-strip portion 26. A protrusion 29, on which a later-described flexing portion of the binding leg-pressing portion 23 abuts, is disposed on the side of the lower surface of the second curved-strip portion 26 on the lower side in FIG. 6(B). A bulge portion 30 that is formed by slightly swelling the lower surface of the second curved-strip portion 26 is disposed contiguous to the protrusion 29 (see FIG. 9(B)).

Figure 11:
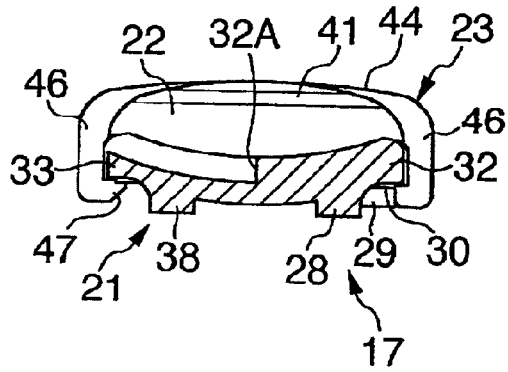
FIG. 11 is an enlarged cross-sectional view of FIG. 6(A) taken along a line E—E.
Figure 12:
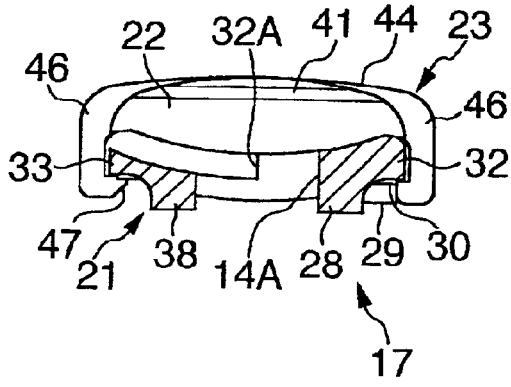
FIG. 12 is an enlarged cross-sectional view of FIG. 6(A) taken along a line F—F.
Figure 13:
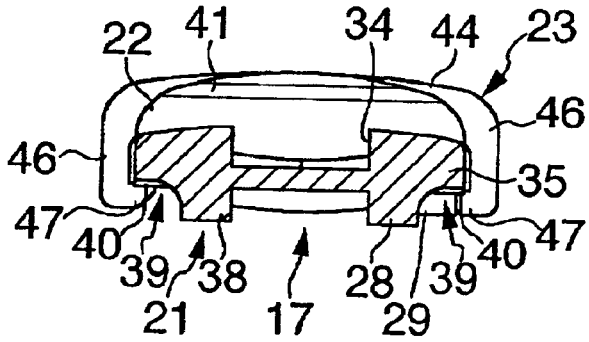
FIG. 13 is an enlarged cross-sectional view of FIG. 6(A) taken along a line G—G.
Figure 15:
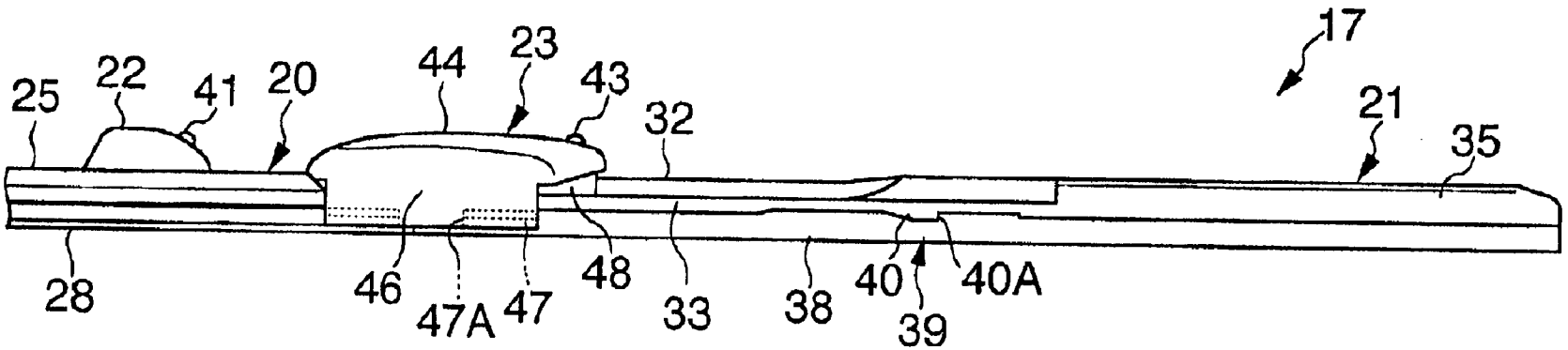
FIG. 15 is a partially enlarged front view of FIG. 5(A).

As shown in FIG. 6(A), the second transverse portion 21 has a first passage-forming portion 32, a second passage-forming portion 33, a third passage-forming portion 35, a second protrusive bar portion 38, and a pair of stoppers 39. The first passage-forming portion 32 extends from the second curved-strip portion 26 and forms an upper-left inner peripheral edge of the passage 14A in FIG. 6(A). The second passage-forming portion 33 extends downwards in FIG. 6(A) from the first passage-forming portion 32 via an elevation 32A and forms a lower-left inner peripheral edge of the passage 14A. The third passage-forming portion 35 extends to the right from the first and second passage-forming portions 32, 33 and forms a right inner peripheral edge of the passage 14A. A recess 34 (see FIG. 13) capable of receiving a corresponding one of the binding legs 13, 13 in a folded-down posture is formed on the side of an upper surface of the third passage-forming portion 35. The second protrusive bar portion 38 extends substantially parallel to the first protrusive bar portion 28 and is disposed symmetrical to the first protrusive bar portion 28 with respect to the passage 14A. In FIG. 13, one of the stoppers 39, 39 is located on the right side of the first protrusive bar portion 28, and the other stopper 39 is located on the left side of the second protrusive bar portion 38. The stoppers 39 can be engaged with the later-described flexing portion of the binding leg-pressing portion 23. As shown in FIGS. 8 and 11, while the first passage-forming portion 32 has substantially the same cross-sectional shape as the second curved-strip portion 26, the second passage-forming portion 33 has an upper surface of a reduced height so that the second passage-forming portion 33 is substantially half as thick as the first passage-forming portion 32. As shown in FIG. 15, each of the stoppers 39, 39 is constructed of a protrusion 40 protruding downwards. A vertical surface 40A constitutes a right flank of the protrusion 40 shown in FIG. 15.

Figure 14:
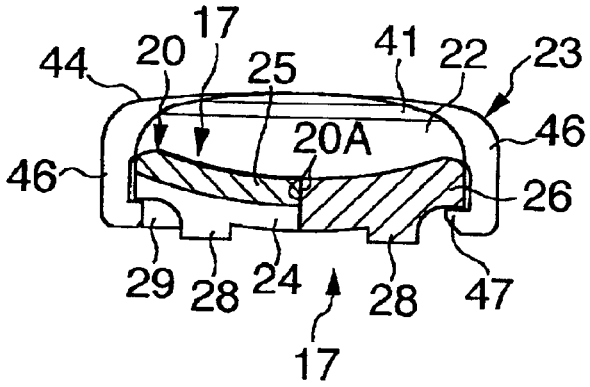
FIG. 14 is an enlarged cross-sectional view of FIG. 5(A) taken along a line H—H.

As shown in FIG. 5(A), the width of the first operating portion 22 of each of the base-forming members 17, 17 is set so as to fall within the width of the surface thereof when the base-forming members 17 are combined with each other. As shown in FIG. 6(A), the upper-half region of the first operating portion 22 extends from the second curved-strip portion 26 and the lower-half region of the first operating portion 22 sticks out from the second curved-strip portion 26. As shown in FIG. 14, the first operating portion 22 is curved at its lower-left end along the upper surface of the first transverse portion 20 of the other base-forming member 17, whereby the first operating portion 22 can be slid on the first transverse portion 20. While the first operating portion 22 is substantially as high as the binding leg-pressing portion 23, an anti-skid protrusive bar 41 (see FIG. 6(A)) assuming a circular shape in a plan view is formed on the side of the upper surface of the first operating portion 22.

Figure 16:
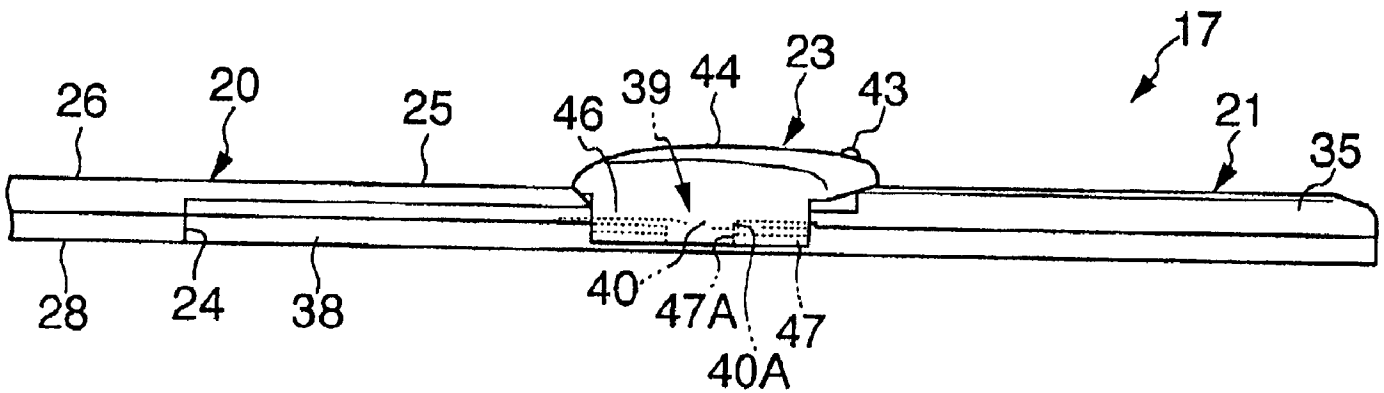
FIG. 16 is a partially enlarged front view of FIG. 5(B).
Figure 17:
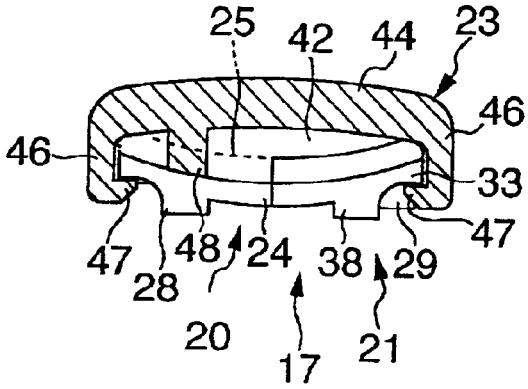
FIG. 17 is an enlarged cross-sectional view of FIG. 6(A) taken along a line I—I.
Figure 18:
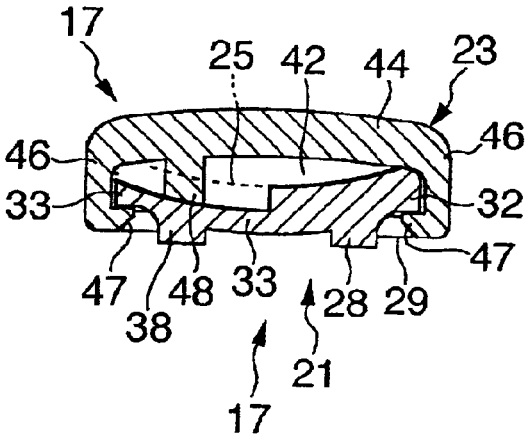
FIG. 18 is an enlarged cross-sectional view of FIG. 5(A) taken along a line J—J.

As shown in FIGS. 17 and 18 as well, the binding leg-pressing portion 23 is formed in such a shape as to embrace the other one of the base-forming members 17, 17 that are combined with each other. That is, the binding leg-pressing portion 23 has a rising portion 42, an upper surface portion 44, a pair of drooping surface portions 46, 46, a pair of claw-shaped flexing portions 47, 47, and a spacer 48. The rising portion 42 extends from the first curved-strip portion 25 and rises slightly. The upper surface portion 44 extends from an upper end of the rising portion 42 and assumes the shape of a bridge in a plan view. An anti-skid protrusive bar 43 assuming a circular shape in a plan view is formed on an upper surface of the upper surface portion 44. The drooping surface portions 46, 46 droop respectively from left and right sides of the upper surface portion 44 in FIGS. 17 and 18. Each of the claw-shaped flexing portions 47, 47 extends from a lower end of a corresponding one of the drooping surface portions 46, 46 and is directed inwards. The spacer 48 extends downwards from a lower surface of the upper surface portion 44. A tip of the spacer 48 is located on the second passage-forming portion 33 of the other base-forming member 17. The flexing portion 47 shown on the left side in FIG. 16 cooperates with the spacer 48 and sandwiches a lateral end of the second passage-forming portion 33 from above and from below. On the other hand, the flexing portion 47 shown on the right side in FIG. 16 interacts with the upper surface portion 44 and sandwiches a lateral end of the first passage-forming portion 32 from above and from below. Thereby it becomes possible to combine the base-forming members 17, 17 integrally. Also, the binding leg-pressing portion 23 is allowed to be slid in a direction perpendicular to the sheets of FIGS. 17 and 18. As shown in FIGS. 15 and 16, each of the flexing portions 47, 47 is split in the left-to-right direction in FIG. 15, so that the protrusion 40 can be received.

A method of assembling the base 14 will now be described.

In assembling the base 14, the base-forming members 17, 17 are first of all disposed in such a manner as to be directed oppositely in the left-to-right direction in FIG. 6(A). The base-forming members 17, 17 are then superimposed on each other such that the first operating portion 22 of one of the base-forming members 17, 17 locally coincides in its region sticking out from the second curved-strip portion 26 with the first curved-strip portion 25 of the other base-forming member 17. In this state, the binding leg-pressing portion 23 of one of the base-forming members 17, 17 and the second transverse portion 21 of the other base-forming member 17 are superimposed on each other and are then pressed in the thickness direction. Thereby the binding leg-pressing portion 23 is fitted to the second transverse portion 21 while embracing it. Thus, assemblage of the binder 10 is completed. In this case, the base-forming members 17, 17 are combined with each other with a clearance formed in the thickness direction.

The base 14 thus assembled allows the base-forming members 17, 17 to move relative to each other in the longitudinal direction. This relative movement allows the first operating portion 22 and the binding leg-pressing portion 23 of one of the base-forming members 17, 17 and the first operating portion 22 and the binding leg-pressing portion 23 of the other base-forming member 17 to move toward and away from each other, respectively. For instance, if the first operating portion 22 on the left side is moved toward the first operating portion 22 on the right side (to the right) in a state shown in FIG. 5(A), only the binding leg-pressing portion 23 on the right side moves to the right. As a result, the binding leg-pressing portion 23 on the left side and the binding leg-pressing portion 23 on the right side move away from each other. If these binding leg-pressing portions 23, 23 are moved toward each other in a state shown in FIG. 5(B), they move as opposed to the aforementioned case. As a result, the first operating portions 22 move away from each other. Accordingly, the first operating members 22, 22 and the binding leg-pressing portions 23, 23 are designed to move in opposed directions when the base-forming members 17, 17 move relative to each other.

It will now be described how the binder 10 of this embodiment is used.

It is assumed herein, as shown in FIG. 4, that the base-forming members 17, 17 are set in such a positional relation that the passages 14A, 14A are open and that each of the binding legs 13, 13 is inserted through a corresponding one of the binding holes P1, P1 formed in the paper P. In the case where the paper P is bound in this state, each of the binding legs 13, 13 is inserted through a corresponding one of the passages 14A, 14A so as to lay the base 14 on the paper P. Then, two fingers of one hand such as a thumb and an index finger are applied respectively to the first operating portions 22, 22 that are spaced from each other, so as to move them toward each other. Thus, the binding leg-pressing portions 23, 23 are slid away from each other. The claw-shaped protrusion 14B then approaches a corresponding one of the binding leg-pressing portions 23, 23. As a result, each of the binding legs 13, 13 is folded down on the side of the lower surface of the upper surface portion 44 in a crawling manner. Finally, each of the binding legs 13, 13 is sandwiched between the upper surface portion 44 and a bottom portion of the recess 34 and is pressed by the binding leg-pressing portion 23. Thus, the binding legs 13, 13 are maintained in a bound posture. In this case, as shown in FIGS. 15 and 16, the flexing portion 47 of the binding leg-pressing portion 23 is engaged in its right region shown in FIG. 16 with the vertical surface 40A while bestriding the protrusion 40. A rising counter-force of each of the binding legs 13, 13 presses the binding leg-pressing portion 23 upwards, and an inner end surface 47A of the flexing portion 47 shown on the right side in FIG. 16 faces the vertical surface 40A. Thus, sliding movements of the base-forming members 17, 17 are prevented.

On the other hand, when canceling the bound posture of the binding legs 13, 13, it is appropriate to pinch the binding leg-pressing portion 23 of one of the base-forming members 17, 17 with the thumb and the binding leg-pressing portion 23 of the other base-forming member 17 with the index finger and move them toward each other. In this case, a certain pressure is applied to each of the binding leg-pressing portions 23, 23 from above. Therefore, each of the binding leg-pressing portions 23, 23 is depressed, so that the inner end surface 47A of a corresponding one of the flexing portions 47, 47 no longer faces the vertical surface 40A. As a result, the inner end surface 47A is disengaged from the vertical surface 40A. Thus, the passages 14A, 14A are opened, and the binding leg-pressing portions 23, 23 release the binding legs 13, 13, which return to their original positions. In this case, since each of the flexing portions 47, 47 abuts on the protrusion 29 and is located on the bulge portion 30, the binding leg portions 13, 13 continue to assume their original positions in which the passages 14A, 14A are open. The passages 14A, 14A are not closed unless an external force is applied by intention.

Accordingly, such an embodiment makes it possible to press and release the binding legs 13, 13 simply and smoothly by alternately performing an operation of moving the first operating portions 22, 22 toward each other and an operation of moving the binding leg-pressing portions 23, 23 toward each other. Because the passages 14A, 14A are formed in the shape of a slot, each of the binding legs 13, 13 can be easily inserted through a corresponding one of the passages 14A, 14A. In addition, since the base 14 is composed of the two base-forming members 17, 17 that are substantially identical in shape, a single mold can be used to form the base-forming members 17, 17. As a result, reduction of the number of parts and simplification of manufacturing processes can be achieved substantially.

The number of the binding legs 13, 13 or the passages 14A, 14A to be formed is not to be limited as in the case shown in the drawings and may be increased if necessary. In short, the present invention accomplishes its aim as long as it is designed such that the base-forming members 17, 17 are combined relatively movably and that the operation of moving the first operating portions 22, 22 toward each other and the operation of moving the binding leg-pressing portions 23, 23 toward each other make it possible to press and release the binding legs 13, 13.

It is not indispensable that the flexing portions 47, 47 be split in the left-to-right direction as shown in FIG. 15. In other words, the flexing portions 47, 47 may be integrated. In this case, if the protrusion 40 is changed in position such that the end surface facing the vertical surface 40A constitutes an outer end surface of each of the flexing portions 47, 47 shown on the left side in FIG. 16, the vertical surface 40A can be engaged with a corresponding one of the flexing portions 47, 47.

Furthermore, the bound posture of the binding legs 13, 13 may also be canceled by moving the first operating portions 22, 22 away from each other so as to move the binding leg-pressing portions 23, 23 toward each other, instead of performing the operation of moving the binding leg-pressing portions 23, 23 toward each other.

As described above, the present invention is designed such that each of the base-forming members has at least one operating portion that moves when the base-forming members are moved relative to each other and that it becomes possible to press or release each of the binding legs by operating the operating portion in a predetermined manner. Therefore, for instance, in the case where two operating portions are arranged in the longitudinal direction in each of the base-forming members, the binding legs can be bound and released simply by being pinched. Thus, papers can be bound and released simply and smoothly, and operational forces can be applied to the operating portions easily.

Further, the present invention is designed such that each of the base-forming members has first and second operating portions that move when the base-forming members are moved relative to each other, that the second operating portions move away from each other and press the binding legs when the first operating portions are moved toward each other, and that the binding legs are released and the first operating portions move away from each other when the second operating portions are moved toward each other. Therefore, operational forces can always be applied in such a direction as to move the first or second operating portions toward each other. This also makes it possible to achieve simplification of operations and maintain good handleability.

Furthermore, in the case where the base-forming members are common in shape and where the base is formed by combining the base-forming members, the number of types of parts constituting the base is reduced. As a result, it becomes possible to achieve structural simplification and reduction in cost.

What is claimed is:

1. A binder, comprising:

a base extending in a longitudinal direction, wherein the base has a plurality of base-forming members that are moveable relative to each other along the longitudinal direction and form passages in the base, and binding legs insertable through the passages of the base; wherein each of the base-forming members has at least one operating portion that moves when the base-forming members are moved relative to each other, and each of the binding legs is pressed or released by operating the corresponding operating portion in a predetermined manner.

2. A binder, comprising:

a base extending in a longitudinal direction, wherein the base has a plurality of base-forming members that are moveable relative to each other along the longitudinal direction and form passages in the base, and binding legs insertable through the passages of the base; wherein each of the base-forming members has first and second operating portions that move when the base-forming members are moved relative to each other, the second operating portions move away from each other and press the binding legs onto binding positions when the first operating portions are moved toward each other, and the binding legs are released from the binding positions and the first operating portions move away from each other when the second operating portions are moved toward each other.

3. The binder according to claim 1, wherein the base-forming members are common in shape, and the base is formed by combining the base-forming members.

4. The binder according to claim 2, wherein the base-forming members are common in shape, and the base is formed by combining the base-forming members.

5. The binder according to claim 1, wherein said base consists of two said base-forming members.

6. The binder according to claim 5, wherein said base-forming members are identical and each of said base-forming members, including said at least one operating portion, is integrally made from a molded material.

7. The binder according to claim 1, wherein each of said base-forming members defines one of the passages of said base, and has in a vicinity of an opening of said one passage a protrusion engageable with a serrated surface of one of the binding legs.

8. The binder according to claim 1, wherein one of said base-forming members has a portion that is received and retained in a cavity of a holding element of the other base-forming member, whereby said base-forming members are slidably attached one to another.

9. The binder according to claim 1, wherein each of said base-forming members includes, in the longitudinal direction:

a first section carrying said at least one operating portion; and a second section that defines one of the passages of said base.

10. The binder according to claim 9, wherein said at least one operating portion of each of said base-forming members has a general U shape and embraces the second section of the other base-forming member.

11. The binder according to claim 9, wherein the second section of each of said base-forming members includes a stop element that engages said at least one operating portion of the other base-forming member, in a state where said at least one operating portion presses one of the binding legs, so as to prevent said at least one operating portion from releasing the binding leg.

12. The binder according to claim 11, wherein the stop element is disengaged from said at least one operating portion when said at least one operating portion is pressed towards the pressed binding leg.

13. The binder according to claim 10, wherein said at least one operating portion has two flexible portions each extending from a free end of one of two branches of the U shape toward the other of the two branches of the U shape.

14. The binder according to claim 13, wherein each of said base-forming members includes a bulge element that releasably engages the flexible portions of said at least one operating portion of the other base-forming member, in a state where said at least one operating portion does not press the corresponding one of the binding legs.

15. The binder according to claim 9, wherein, when said base-forming members are assembled together, said at least one operating portion of each of said base-forming members is slidable in the longitudinal direction from one side to other side of the passage of the other base-forming member.

16. The binder according to claim 9, wherein for each of said base-forming members, said second section is about twice as wide as the first section.

17. The binder according to claim 2, wherein said base consists of two said base-forming members.

18. The binder according to claim 2, wherein one of said base-forming members has a portion that is received and retained in a cavity of a holding element of the other base-forming member, whereby said base-forming members are slidably attached one to another.

19. The binder according to claim 2, wherein each of said base-forming members includes, in the longitudinal direction:

a first section carrying said first and second operating portions; and a second section that defines one of the passages of said base;

wherein said second operating portion of each of said base-forming members has a general U shape and embraces the second section of the other base-forming member.

20. The binder according to claim 19, wherein said second operating portion has two flexible portions each extending from a free end of one of two branches of the U shape toward the other of the two branches of the U shape.

* * * * *